US009302321B2

(12) United States Patent
Nitzl et al.

(10) Patent No.: US 9,302,321 B2
(45) Date of Patent: Apr. 5, 2016

(54) CERAMIC REFRACTORY STOPPER

(75) Inventors: Gerald Nitzl, Baden (AT); Arno Stranimaier, Trieben (AT); Hans-Jurgen Haslinger, Trieben (AT); Helmut Kaufmann, Gaishorn/See (AT)

(73) Assignee: REFRACTORY INTELLECTUAL PROPERTY GmbH & Co., Vienna (AT)

( * ) Notice: Subject to any disclaimer, the term of this patent is extended or adjusted under 35 U.S.C. 154(b) by 185 days.

(21) Appl. No.: 14/239,273

(22) PCT Filed: Jun. 28, 2012

(86) PCT No.: PCT/EP2012/062608

§ 371 (c)(1),
(2), (4) Date: Feb. 18, 2014

(87) PCT Pub. No.: WO2013/041258

PCT Pub. Date: Mar. 28, 2013

(65) Prior Publication Data

US 2014/0217654 A1 Aug. 7, 2014

(30) Foreign Application Priority Data

Sep. 23, 2011 (EP) ..... 11182436

(51) Int. Cl.
*B22D 41/18* (2006.01)

(52) U.S. Cl.
CPC ..... *B22D 41/186* (2013.01)

(58) Field of Classification Search
CPC ..... B22D 41/186
USPC ..... 266/217
See application file for complete search history.

(56) References Cited

U.S. PATENT DOCUMENTS

2007/0210494 A1* 9/2007 Guillo ..... B22D 41/186 266/217
2010/0163586 A1* 7/2010 Funato ..... B22D 41/186 222/602

FOREIGN PATENT DOCUMENTS

| | | | |
|---|---|---|---|
| DE | 102007004958 | A1 | 8/2008 |
| EP | 1188502 | B1 | 1/2005 |
| FR | 2728491 | A1 | 6/1996 |
| JP | 2008080397 | A | 4/2008 |

OTHER PUBLICATIONS

Richard, "Optimization of casting stoppers", Revue de Métallurgie, Apr. 2003, pp. 409-414, vol. 100, No. 4.

* cited by examiner

*Primary Examiner* — Scott Kastler
(74) *Attorney, Agent, or Firm* — Walker & Jocke

(57) ABSTRACT

The invention relates to a ceramic refractory stopper (a stopper device) for controlling a flow of molten metal at an outlet opening of a metallurgical vessel, such as a tundish.

11 Claims, 4 Drawing Sheets

CERAMIC REFRACTORY STOPPER

The invention relates to a ceramic refractory stopper (a stopper device) for controlling a flow of molten metal at an outlet opening of a metallurgical vessel, such as a tundish.

The generic type of ceramic refractory stoppers comprises a rod-shaped stopper body, one end of which being designed for fixation to a corresponding lifting mechanism while the other end of which is provided by the so called stopper head. The rod-shaped stopper body defines a central longitudinal axis.

Figure 1:
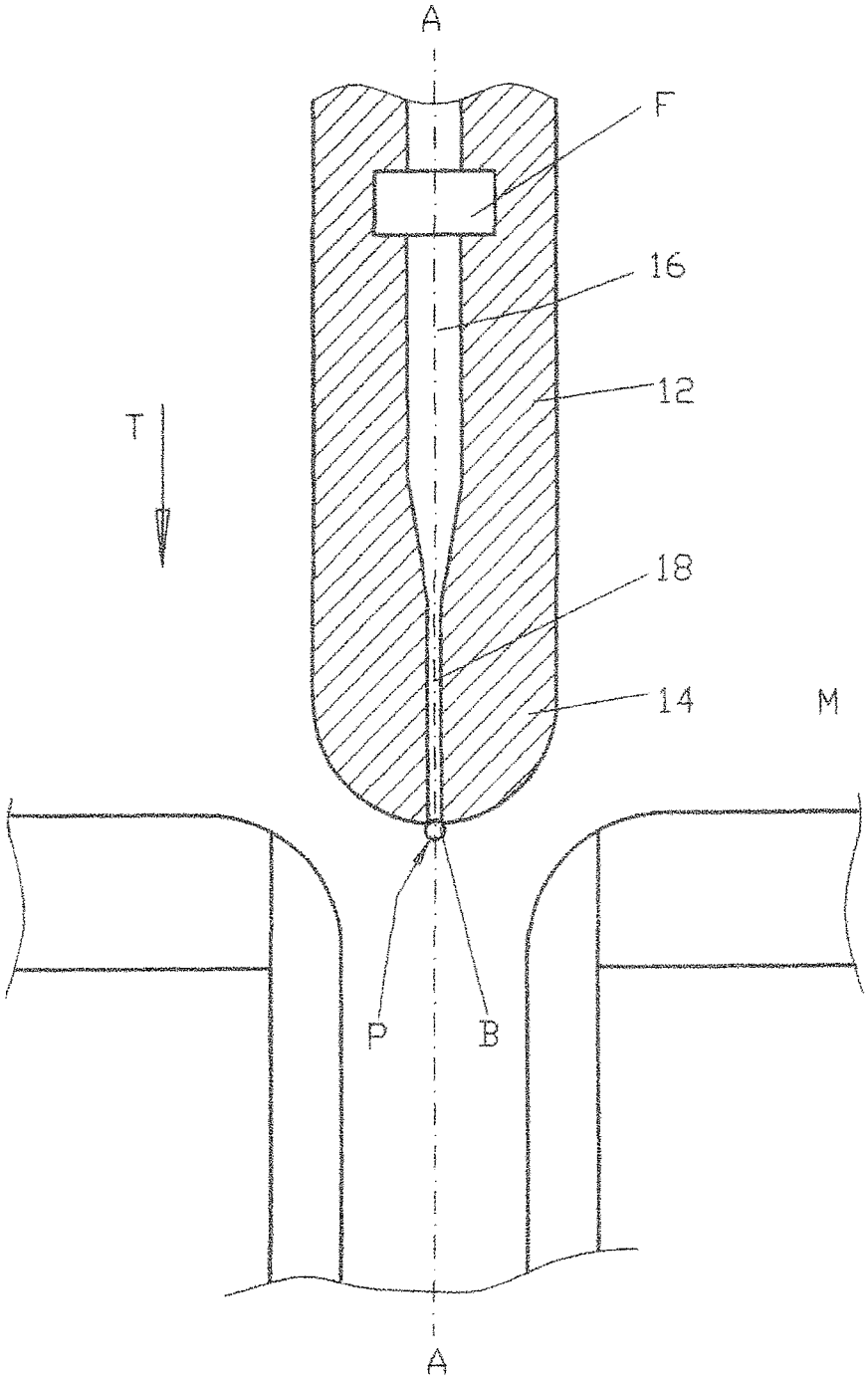

It is well known in steel casting to arrange such a stopper rod, which in many cases is a one-piece-stopper rod, in a vertical position, in order to vary the cross-sectional area of an associated outlet opening of a corresponding metallurgical vessel by said lifting action. Insofar any directions disclosed hereinafter, like "top", "bottom", "upper and lower ends" always refer to the vertical use position as shown in FIG. 1 of the attached drawing.

Stopper rods of this type have also being used to introduce a gas, such as an inert gas, i. a. argon, into the molten steel for removing non-metallic inclusions from the molten melt.

According to EP 1188502 B1 the gas is fed along a central gas feeding line from the upper end of the stopper towards a stopper head. Typically this gas feeding line is provided by a central bore hole within the stopper body. EP 1188502 B1 provides various embodiments to continue the gas flow downwardly through the stopper head to its outer surface and further into the surrounding melt. According to the embodiment of FIG. 6 (*a*) of said EP 1188502 B1 the main gas feeding line merges into one single gas channel of reduced diameter, wherein said gas channel extends along the central longitudinal stopper axis so as to leave the stopper head at its lowermost surface section (prior art: FIG. 1)

Accordingly, the gas leaves the stopper device in the direction of the central longitudinal axis. Around this exit area the corresponding metal melt has a relatively low velocity which has the disadvantage that the argon transport is slowed, down and so called clogging (deposition of solidified material) occurs around the exit opening of said gas channel at the outer surface of the stopper head.

According to the embodiment of FIG. 6 (*b*) of EP 1188502 B1 the one gas channel is replaced by a number of gas channels, all starting at the same point, which is along the central longitudinal stopper axis, but then diverging towards the free outer surface of the stopper head.

This design only reduces the occurrence of clogging. Solidified steel particles may close the corresponding gas channels.

It is an object of the present invention to provide a stopper device for flow control of molten metal from a vessel which avoids the above-mentioned disadvantages and improves the steel quality.

The invention starts from a conventional ceramic refractory stopper of the generic type mentioned above comprising a rod-shaped stopper body, defining a central longitudinal stopper axis, and at least one gas feeding line, extending within said stopper body towards a stopper head.

According to the invention further transport of the gas (downwardly into the stopper head and via at least one gas channel outlet opening into the melt) is achieved by the following design:

- the at least one gas feeding line merges into a cylindrical gas channel,
- said cylindrical gas channel extends concentrically to the central longitudinal stopper axis within the stopper head to its free outer surface.

Contrary to the discrete gas channels (gas blowing holes) according to prior art a cylindrical gas channel is provided within a stopper head (also called the nose portion of the stopper body). Depending on the diameter of said cylindrical gas channel, especially at its one ring-shaped outlet opening, the gas is fed at a distinct distance to the lowermost point of the stopper head (in its use position) and insofar at a place where the metal melt passes with increased velocity.

This guarantees that the gas, leaving the stopper (stopper nose), is flushed away by the metal melt stream without the danger of clogging.

The inventive idea is based on the technical feature to provide a ring-shaped outlet opening of a gas channel at the outer surface of the lower end of the stopper body which corresponds to the lower outer surface of the stopper head (stopper nose), which typically has a curved design.

The gas slit should run at a certain distance to the central longitudinal axis of the stopper body, such that the gas leaves the stopper head at a position above the lowermost point of the stopper head, where the passing melt stream has a higher velocity. This radial distance should heat least ten times the width of said gas channel and can be 20 or 30 times larger. The specific size may be about 0.5-8 cm, for example 1-6 cm.

According to one embodiment the width of the gas channel, perpendicular to the gas feeding direction, is less than 1 mm, for example 0.6, 0.5, 0.4 or 0.3 mm and insofar much smaller than any discrete bore like gas channel according to prior art with a diameter of typically between 1 and 5 mm.

Due to the cylindrical geometry and the small width of the gas channel gas flow is effected between an inner and an outer hot surface, improving the heat exchange between stopper body and gas, which exits the gas channel with a much higher temperature compared with conventional prior art devices as mentioned. The hotter gas further avoids solidification of any melt at the gas channel exit as well as melt infiltration into the gas channel As far as the invention refers to a "cylindrical gas channel" it should be noted that the term "cylindrical" does not necessarily means a cylinder of constant diameter although this is one possible embodiment.

Accordingly the invention provides various designs, such as:

a) the cylindrical gas channel extends parallel to the central longitudinal stopper axis,
b) the cylindrical gas channel has a smaller diameter at its end within the stopper head and a larger diameter at its end along the free outer surface of the stopper head,
c) the cylindrical gas channel has a larger diameter at its end within the stopper head and a smaller diameter at is end along the free outer surface of the stopper head.

Alternatives b) and c) include gas channels extending at least partially radially to the central longitudinal stopper axis. All gas channel designs include the feature of a ring-shaped gas outlet opening of said gas channel at the stopper head surface. The invention includes embodiments with more than one cylindrical gas channel in the stopper head region, which then being arranged concentrically, while the surrounding refractory parts are fixed to each other, for example by refractory bridges as will be described hereinafter.

As mentioned above conventional ceramic refractory stoppers can be manufactured as so called monoblock stoppers (one-piece stoppers). Such monoblock design may also be realised within the inventive concept but obviously refractory bridges must be provided along the cylindrical gas channel in order to avoid separation between the refractory material inside and outside the gas channel. In this respect it is known from gas purging plugs to insert a corresponding template within the ceramic material which template corresponds to the cylindrical design of the final gas channel and including holes along its wall section. During manufacturing of the stopper body, for example by pressing, especially isostatic pressing, the ceramic batch material then passes these holes, providing material (ceramic) bridges.

During subsequent firing of the pressed stopper the template material burns off, thus providing the desired cylindrical gas channel with monolithic refractory bridges as described before.

Another design of the new ceramic refractory stopper is characterized by an insert, arranged within the stopper head such that the insert provides one inner wall section of the gas channel while the stopper head provides the other, outer wall section of said cylindrical gas channel.

Various embodiments of designs of such insert may be realised.

According to one embodiment the insert comprises a first section, providing an inner surface of the cylindrical gas channel and an associated second section (on top), providing the boundary of said at least one gas feeding line, or, in an alternative, providing a second section with the said gas feeding line running there through. In other words, the gas feeding line is realised at its end next to and/or within the stopper nose between said insert and the inner wall of the stopper body (including the nose portion) as shown the attached drawing. This design allows to provide more than one gas feeding line continuing the gas feed into the cylindrical gas channel.

In order to realise the gas feeding line(s) and/or gas channel one or more corresponding template(s) may be installed as described before and burned off after moulding. Instead of a combustible template at least one of the corresponding surfaces may be covered by a combustible wax and/or other combustible materials such as a plastic foil.

This allows to pre-mould the insert, cover it by said combustible material and then have it pressed together with the stopper body for example in an isostatic press device. Combustion of a combustible material may be achieved during subsequent firing (sintering) of this ceramic stopper.

In order to achieve optimized gas flow one embodiment provides a rotationally symmetrical insert.

According to a further embodiment the insert may be profiled along its outer surface. The outer surface of said insert may provide at least one protrusion or at least one depression which fit with at least one corresponding depression or at least one corresponding protrusion along a corresponding inner surface of the stopper head to achieve a form fit connection between insert and stopper head and insofar to avoid loosening of said insert. Other tongue and groove connections and/or other fastening means like bolts may be used for the same purpose.

The technical effect of this design corresponds to the "refractory bridges" as mentioned above.

In case of said refractory bridges a continuous ceramic or chemical bonding may be realised between stopper body (including stopper head) and insert.

Further features of the invention will derive from the subclaims and the other application documents. The stopper may be realised by arbitrary combinations of design features disclosed if not explicitly excluded.

It should be noted that terms like "rod-shaped" etc. always refer to the manufactured technical product and insofar refer to corresponding technical features and are not used in a strong mathematical sense.

Prior art and the invention will now be described with respect to the attached schematic drawing, showing in:

FIG. 1: A conventional stopper rod according to prior art and the associated outlet opening of a metallurgical vessel.

Figure 2:
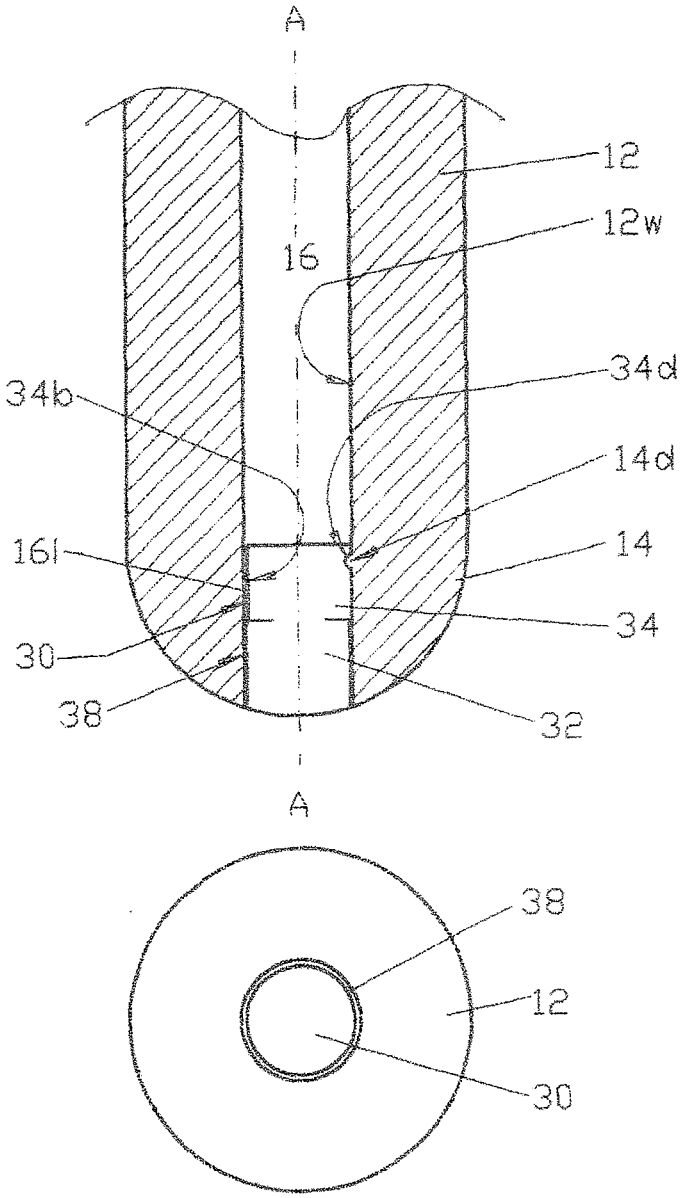

FIG. 2: A sectional view of a first embodiment of the new stopper.

Figure 3:
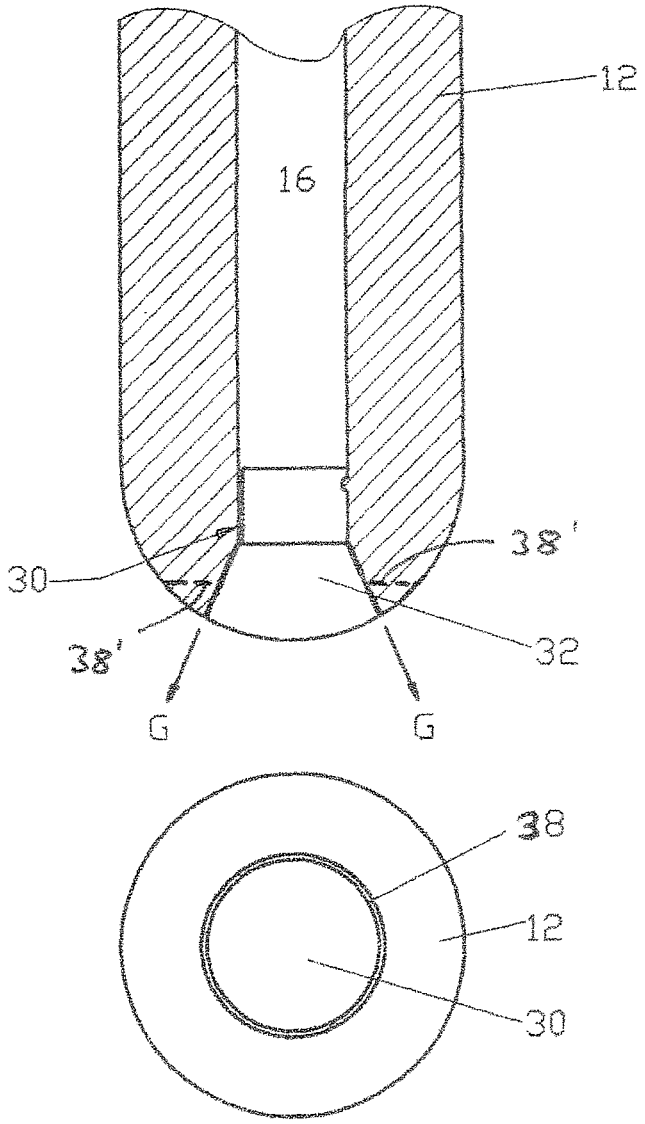

FIG. 3: A second embodiment of an insert.

Figure 4:
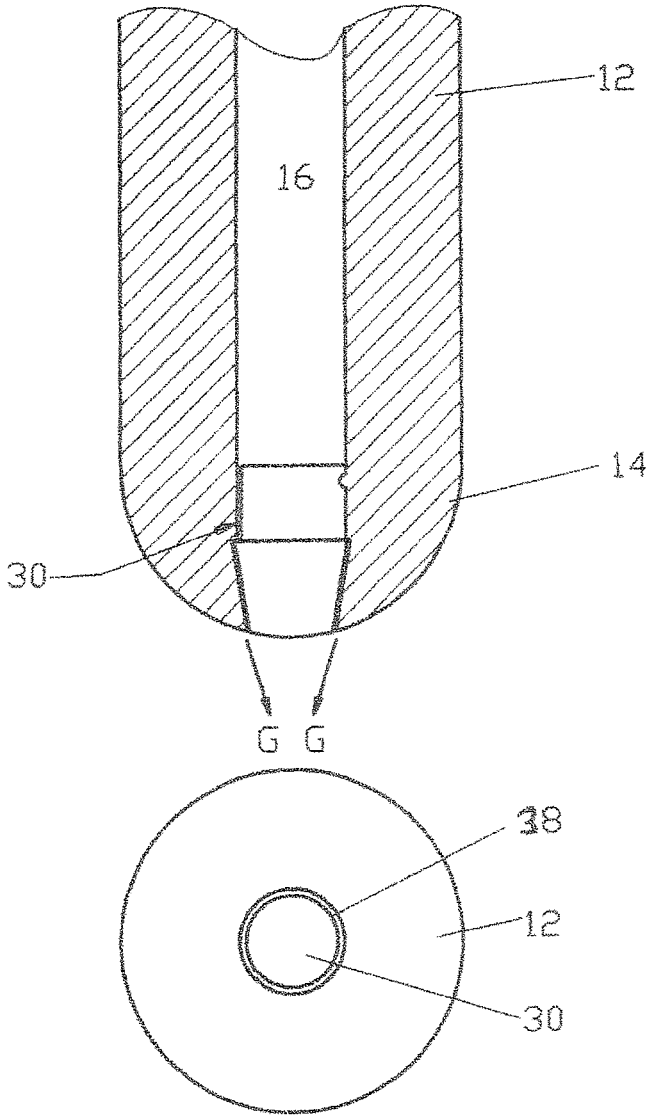

FIG. 4: A third design of an insert.

The stopper design according to FIG. 1 corresponds to that of EP 1188502B1 (FIG. 6a). The stopper has a stopper body 12 with a stopper head 14 at its lower end and fixation means F (for a corresponding lifting apparatus) at its upper end. A gas is transported along a central gas feeding line 16 in the direction arrow T towards stopper head 14 into a gas channel 18 of reduced inner diameter and leaves the stopper at the lowermost point P of this gas channel 18 and said stopper in the shown use position and in axial alignment with a central longitudinal axis (A-A) of the stopper.

At this point P a corresponding metal melt M has a relatively low velocity. This is the reason why a relative large gas bubble B may be formed around the outlet opening of the channel 18 and clogging occurs.

FIG. 2 shows the lower part of the new stopper design. In accordance with prior art stopper body 12 provides a central gas feeding line 16 and stopper head 14. The central longitudinal axis of this stopper is characterized again by line A-A.

Concentrically to said axis A-A a cylindrical insert 30 of constant diameter is arranged within said stopper head and in extension of gas feeding line 16. Insert 30 has a first lower section 32 and a second upper section 34. Upper section 34 provides an inner boundary 34*b* of a lower section of feeding line 16, which is characterized in this section by three individual gas lines 16*i*, running vertically (and downwardly) towards the first lower section 32 of insert 30 at a distance to each other, here: at 120 degrees to each other. Therefore in the sectional view of FIG. 2 only one of said three gas lines 16*i* may be seen.

Upper section 34 is further characterized by a surface depression 34*d* into which a corresponding (radial) protrusion 14*d* of inner wall 12*w* of stopper body 12 enters in a form fit way so as to avoid disintegration of stopper body 12 (or stopper head 14 respectively) and insert 30.

The three gas lines 16*i* are in fluid communication with gas feeding line 16 and in fluid communication with a cylindrical gas channel 38 arranged between the lower part 32 of insert 30 and the corresponding inner wall section 12*w* of stopper head 14.

The flow of gas is as follows:

The gas flows along gas feeding line 16 downwards (arrow T), then into the three gas feeding lines 16*i* arranged between upper section 34 of insert 30 and inner wall 12*w* of stopper body 12 and finally along the cylindrical gas channel 38 before it leaves the stopper head 14 via its ring shaped gas outlet opening (with a diameter about 6 cm) at the free tower end of gas channel 38 and enters into the metal melt M.

Gas channel 38 has a width (perpendicular to axis A-A) of 0.6 mm and avoids the risk of melt infiltration, while at the same time allows the melt stream passing this ring shaped outlet opening, to flush away the escaping gas stream without any danger of clogging.

The embodiment of FIG. 3 is similar to that of FIG. 2 with the proviso that the lower section 32 of insert 30 has the shape of truncated cone and correspondingly a trapezoidal cross section in the sectional view of FIG. 3.

The gas stream leaves this gas channel 38 in the direction of arrow G.

An alternative of the arrangement of insert 30 and gas channel 38 respectively is represented in FIG. 3 by dotted lines 38' and characterized by an end portion of gas channel

38' extending radially with respect to the central longitudinal axis of the stopper and thus horizontally in the shown position.

The stopper of FIG. 4 corresponds to that of FIG. 3 with the proviso that the lower part 32 of insert 30 is inclined the other way round, i.e. its diameter is larger at its end facing the upper section 34 than at its lower end, i.e. at the ring shaped gas outlet opening.

It may further be derived from FIG. 3 that insert 30 has a curved lower surface so as to follow the dome-like shape of the lower end of stopper head 14.

FIG. 2-4 in their lower part disclose a view onto the stopper head from below.

The invention claimed is:

1. Ceramic refractory stopper, comprising a) a rod-shaped stopper body (12) defining a central longitudinal stopper axis (A) and b) at least one gas feeding line (16), extending within said stopper body (12) towards a stopper head (14), wherein c) the at least one gas feeding line (16) merges into a cylindrical gas channel (38)

d) which cylindrical gas channel (38) extends concentrically to the central longitudinal stopper axis (A) within the stopper head (14) to a free outer surface of the stopper head; and wherein the cylindrical gas channel (38) extends between an insert (30), arranged within the stopper head (14), and the stopper body (12).

2. Ceramic refractory stopper according to claim 1, wherein the cylindrical gas channel (38) extends parallel to the central longitudinal stopper axis (A).

3. Ceramic refractory stopper according to claim 1, wherein the cylindrical gas channel (38) has a smaller diameter at its end within the stopper head (14) and a larger diameter at its end along the free outer surface of the stopper head (14).

4. Ceramic refractory stopper according to claim 1, wherein the cylindrical gas channel (38) has a larger diameter at its end within the stopper head (14) and a smaller diameter at its end along the free outer surface of the stopper head (14).

5. Ceramic refractory stopper according to claim 1, wherein the cylindrical gas channel (38) has a width, perpendicular to the gas feeding direction, of less than 1 mm.

6. Ceramic refractory stopper according to claim 1, wherein the cylindrical gas channel (38) has a width, perpendicular to the gas feeding direction, of less than 0.6 mm.

7. Ceramic refractory stopper according to claim 1, wherein the insert (30) comprises a first section (32), providing an inner surface of the cylindrical gas channel (38) and an associated second section (34), providing a boundary (34 *b*) of said at least one gas feeding line (16 *i*) or within the said gas feeding line (16 *i*) runs.

8. Ceramic refractory stopper according to claim 1, wherein the insert (30) is rotationally symmetrical.

9. Ceramic refractory stopper according to claim 1, wherein the insert (30) is profiled along its outer surface.

10. Ceramic refractory stopper according to claim 9, wherein the outer surface of said insert (30) provides at least one protrusion (14 *d*) or at least one depression which fit with at least one corresponding depression (34 *d*) or at least one corresponding protrusion along a corresponding inner surface (12*w*) of the stopper body (12) to achieve a form-fit connection between insert (30) and stopper body (12).

11. Ceramic refractory stopper according to claim 1, wherein said stopper body (12) including stopper head (14) and said insert (30) provides a continuous ceramic or chemical bonding or both.

* * * * *